US009447967B2

(12) United States Patent
Lam

(10) Patent No.: US 9,447,967 B2
(45) Date of Patent: Sep. 20, 2016

(54) BURNER FORMING AND APPLYING MIXED CYCLONE AND COMBUSTION METHOD USING THE BURNER

(76) Inventor: Kwong Yung Lam, Hong Kong (HK)

( * ) Notice: Subject to any disclaimer, the term of this patent is extended or adjusted under 35 U.S.C. 154(b) by 1407 days.

(21) Appl. No.: 12/865,861

(22) PCT Filed: Apr. 29, 2008

(86) PCT No.: PCT/CN2008/070846

§ 371 (c)(1),
(2), (4) Date: Aug. 3, 2010

(87) PCT Pub. No.: WO2009/100624

PCT Pub. Date: Aug. 20, 2009

(65) Prior Publication Data

US 2010/0330514 A1 Dec. 30, 2010

(30) Foreign Application Priority Data

Feb. 4, 2008 (CN) ..... 2008 1 0065335

(51) Int. Cl.

| | |
|---|---|
| ***F23N 1/02*** | (2006.01) |
| ***F23C 7/00*** | (2006.01) |
| ***F23D 14/62*** | (2006.01) |
| ***B05B 1/34*** | (2006.01) |
| ***F23D 14/02*** | (2006.01) |
| ***F23D 3/08*** | (2006.01) |
| ***F24C 7/00*** | (2006.01) |

(52) U.S. Cl.

CPC ..... *F23D 14/02* (2013.01); *F23D 3/08* (2013.01); *F23D 14/62* (2013.01); *F24C 7/002* (2013.01); *F23D 2900/14021* (2013.01)

(58) Field of Classification Search

CPC ..... F24C 3/08; F24C 7/002; F23D 14/02; F23D 14/62

USPC ..... 126/39 E; 239/466, 467; 431/12, 351, 431/354

See application file for complete search history.

(56) References Cited

U.S. PATENT DOCUMENTS

| | | | | |
|---|---|---|---|---|
| 2,409,129 | A * | 10/1946 | Lange | 126/36 |
| 5,236,350 | A * | 8/1993 | Cummings, III | F23M 20/005 239/399 |
| 6,793,483 | B2 * | 9/2004 | Watanabe | 431/4 |
| 2008/0173298 | A1 * | 7/2008 | Hsu | 126/39 E |

FOREIGN PATENT DOCUMENTS

| | | |
|---|---|---|
| CN | 2081947 | 7/1991 |
| CN | 2233046 | 8/1996 |

OTHER PUBLICATIONS

International Search Report of PCT/CN2008/070846.

* cited by examiner

*Primary Examiner* — William G Corboy

(57) ABSTRACT

This patent application relates to a burner which includes a burner head in the shape of a sleeve, under the burner head is connected with a ring gas-separating box, and in the space between the burner head and the gas-separating box there is a cylinder mixing box to mix the air and gas. Said gas-separating box has a independent center hole to bring in the air and gas inlets to bring in the gas. Several notches which are equispaced with each other and slant upwardly are set on the cylinder surface of the mixing box, while on the surface of the notches are positioned connecting holes to let the air out. Such a structure promotes the mixing process more fully of the dispersed gas and air in the slant upward notches, and the mixed flow rotates upwardly to reach the flame hole as a inversed cone frustum. Due to the full mixing of the gas and air and upward rotation of the mixed flow, the flame will burn more completely and be uneasy to be extinguished.

4 Claims, 8 Drawing Sheets

BURNER FORMING AND APPLYING MIXED CYCLONE AND COMBUSTION METHOD USING THE BURNER

This patent application relates to a kind of combustion technology, more specifically, relates to a method to generate rotating mixture of gas and air which may be used in canteen or kitchen of some hotels, companies and schools etc, and also relates to a burner applying such a method as well as a burning method by said burner.

BACKGROUND

In canteen or kitchen of many hotels, companies or schools, food is heated by gas furnace and common burners which are incapable to burn fuel fully due to incomplete mixing of gas and air, and may produce a flame so long that induce loss of heat, low combustion and produce a large amount of carbon monoxide.

SUMMARY

In the first aspect, aimed at the defect that prior technology has a problem of incomplete mixing of gas and air, this patent application will provide a method to generate rotating blend flow with better mixing of gas and air.

In the second aspect, aimed at the defect that prior technology has a problem of incomplete mixing of gas and air, this patent application will provide a burner and burning method to promote the mixing of the gas and air.

To solve the first problem, a method is provided to generate rotating blend flow, including the following steps:

S1 turn the air and gas into a swirly mixture;

S2 turn the said swirly mixture of gas and air into a spiraling blend flow with its bottom tiny but its top big and having an uprush velocity.

The step S1 may includes the following steps:

S11 turn the air and gas into a rotating mixture by a first blending;

S12 turn the rotating mixture into a swirly mixture by a second blending.

To solve the second problem, a burner is provided which includes a gas-separating box used to bring in gas and air separately, a mixing device used to form a rotating blend flow by the air and gas from the gas-separating box, and a third mixing device to reflect the rotating blend flow to rush out of flame hole and then form a spiraling blend flow with a big top but tiny bottom and having a uprush velocity.

In the burner of present patent application, said mixing device includes a burner head and a mixing box which compose a first mixing device and a second one, said burner head is in a shape of sleeve.

In the burner of present patent application, said first mixing device turns the air from the gas-separating box into a airflow rotating tilted upwardly, said second mixing device turn the rotating air flow and the gas from gas-separating box into rotating blend flow.

In the burner of present patent application, said mixing box is a box having a countersunk hole connected to said centre hole, on the box wall are provided with several separate notches whose amount and position are corresponding to that of the outlets of said gas, on the top of the box are first outlets arranged equispaced.

In the burner of present patent application, said first mixing device turns the air and gas into a rotating blend flow tilted upwardly by a first blending, said second mixing device turns the rotating blend flow from the first mixing device into a swirly blending flow.

In the burner of present patent application, said gas-separating box has a centre hole to let air in and at least one inlet to let gas in, and on the top of the gas-separating box are several gas outlet for gas out.

In the burner of present patent application, said mixing box is a box having a countersunk hole connected to said centre hole, on the box wall are several notches whose amount and position are corresponding to that of gas outlets, on the surface of said notches there are connecting hole connected to the air in said countersunk hole, and the notches will mix the air and gas primarily to form rotating blend flow which is tilted upwardly.

In the burner of present patent application, said notches are tilt upward.

In the burner of present patent application, the angle between said notches and bottom surface of the mixing box is 10 to 80 degree.

In the burner of present patent application, said notches is at least 50 mm long.

In the burner of present patent application, the cross section of said notches is in a shape of square or inverted trapezoidal.

In the burner of present patent application, the flame hole on the burner head for the mixed flow to rush up has a surface like a frustum of a cone which makes the spiraling blend flow reflected to a reflecting plate on the mixing box and then rush out of the flame hole to form a rotating mixed gas flow with its bottom much smaller than its top.

In the burner of present patent application, the size of the flame hole is one fifth or one third the size of the said top cap.

In the burner of present patent application, the gas outlets are equispaced while the connecting holes are equispaced too.

In the burner of present patent application, the diameter of the gas outlet and connecting hole are 0.5 to 3 mm.

In the burner of present patent application, a mounting hole is set through the top surface of said mixing box, said mounting hole has a insulating sleeve which includes a round plate mounted onto the countersunk hole and a ring matched with the mounting hole, on the insulating sleeve has a reflecting plate which is connected with a ground wire of flame ion controller, said mixing box has two pulse lighting-off torch.

In the burner of present patent application, said burner head is screwed onto the gas-separating box.

In the burning method of the burner of present patent application, it includes the following steps:

S01 separate the air and gas into two flow with the first flow of air into the center hole and then into the notch by the equispaced connecting hole to mix with the air of the first flow, and later up along the tilted notch to form a blend flow which rotates slant upwardly;

S02 the slant upward blend flow enters a second mixing chamber, mixed again rotationally to form a swirly blend flow;

S03 the spiraling flow and rotating flow is collided with each other and flows around, and is reflect onto the reflecting plate surface by the cone frustum inclined surface, and then rush up to flame hole to form a spiraling blend flow with its head much larger than the bottom which will become a flame looked like hurricane with its bottom small but head huge.

The burner includes a burner head in the shape of a sleeve, the gas-separating box is connected below the burner head, and between the burner head and gas-separating box is a device for air dispersion and gas mixture, and on the gas-separating box is a center hole to let air in and at least one inlet to let gas in, on the top of the gas-separating box are set several gas outlets to let gas out; said device for air dispersion and gas mixture is a box in which is a countersunk hole connected to the center hole, on the box wall are several spaced notches whose amount and position are corresponding to that of the gas outlets, and on the surface of the notches there are connecting holes connected to the air in the countersunk hole, the notches mix the air and gas primarily; said burner head has a flame hole in the shape of a cone frustum used to burn the gas and reflect the mixture, the inclined surface of the cone frustum of the flame hole reflects the mixture gas to make it rush onto the flame hole, the burner head and the top surface of the device for air dispersion and gas mixture make up the second mixing chamber. Such a structure promotes the dispersed gas and air to be fully mixed up in the notches of the gas mixing device and then flow slanted upward to the second mixing chamber and the flame hole as a cone frustum, the inclined surface of the flame hole reflects the mixed gas onto the reflecting plate and then flame hole and at last become a flame like a hurricane with its bottom small but the top huge, such a flame can be better concentrated and condensed to burn fully with no or less heat conduction between energy and the burner head and in further less carbon monoxide and being uneasy to be extinguished. Besides, the concentration and condensation of the flame reduces needed space to burn, thus reduces the volume of the whole chamber and the burner correspondingly.

In further, in the burner of present patent application, it is not necessary to use a ion detecting pin for the ion flame detector to detect the flame, only the ground wire of the ion flame detector being connected onto the insulated reflecting plate is needed. The detection can be achieved by the wire of the ion detecting pin connecting onto a metal piece of the burner. The burning of the flame produces ion, the flame leg is zero while the burning flame is positive (the ground wire is required to be connected onto the insulated reflecting plate, then ion detecting wire is connected to the meter piece of the burner, thus, when the meter is on fire, the meter will produce positive ion when sense the fire flame, so the ion flame detector tells that the burner is on fire.).

BRIEF DESCRIPTION OF THE DRAWINGS

More details will be described by referring to the following drawing and embodiments, in which.

DETAILED DESCRIPTION

Figure 1:
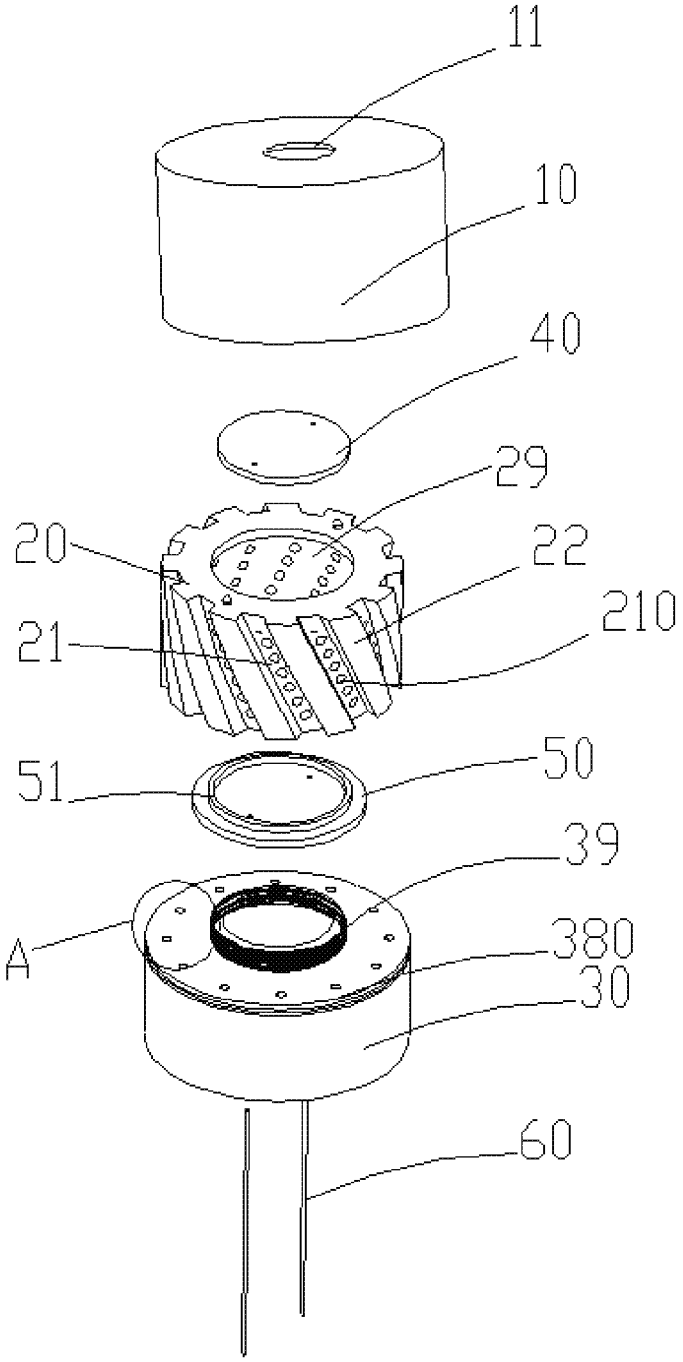
FIG. 1 is the exploded drawing of a first embodiment of the burner of present patent application.
Figure 2:
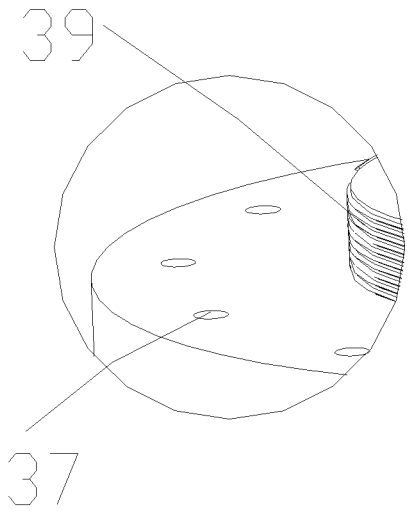
FIG. 2 is the enlarged drawing of part A of FIG. 1.
Figure 3:
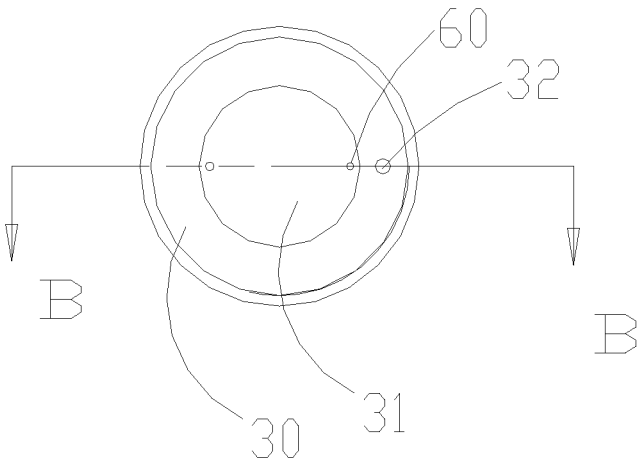
FIG. 3 is the top view of the first embodiment of the burner of present patent application.
Figure 4:
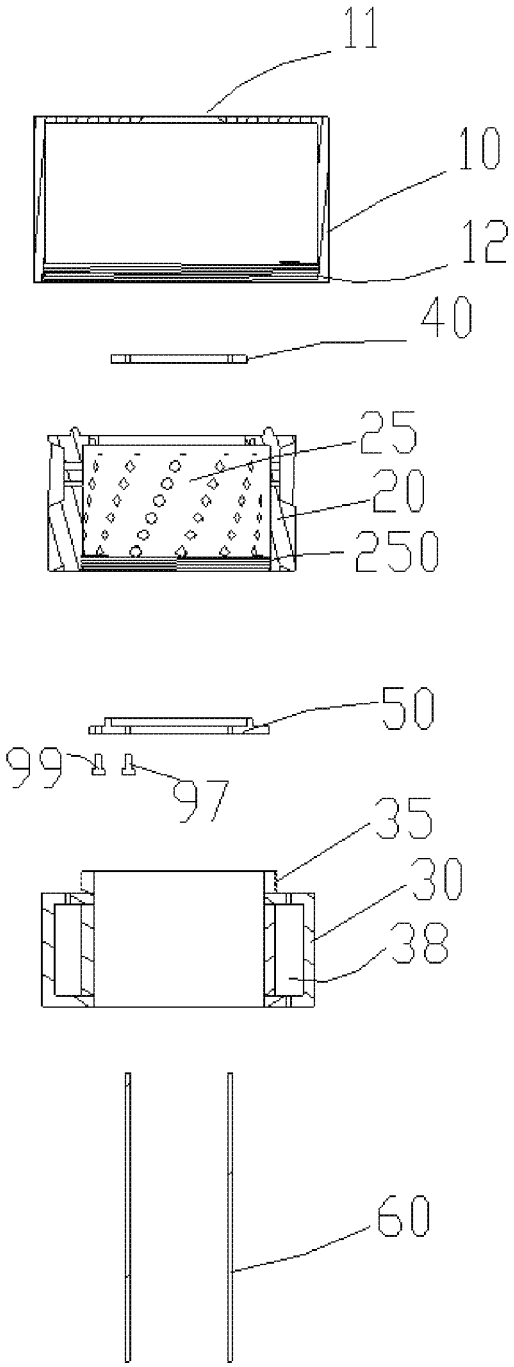
FIG. 4 is the exploded B sectional view of FIG. 3.

This patent application provides a method to generate a rotating blend flow by air and gas, including the following steps:

S1 mix air and gas into a swirly blend gas;

S2 turn the swirly blend gas from the step S1 into a spiraling blend flow with a velocity of rushing up and its bottom tapering but the top large.

The step S1 includes the following steps:

S11 turn the air and gas into a rotating mixture by a first blending;

S12 turn the rotating mixture into a swirly mixture by a second blending.

The embodiment 1 is the overall process of generating the rotating mixture gas flow, while the embodiment 2 includes step S1 and S2, but step S1 does not include step S11 and S12. More details will be described referring to the drawings.

As shown in FIG. 1, the burner of present patent application includes a gas-separating box 30 used to bring in gas and air, a mixing device used to mix the gas and air from the gas-separating box and turn them into a rotating blend flow, and a third mixing device used to reflect the rotating blend flow to make it rush out of flame hole 11 and to form a spiraling blend flow with its bottom sharp but top large and having a uprush velocity, wherein the mixing device includes a burner cover 10 and mixing box 20 composed of a first mixing device and a second mixing device.

The gas-separating box 30 is a round ring, includes a center hole 31 and box body, wherein the box body is a cylinder, has several gas outlets 37 positioned along a circle on the top surface to disperse gas and a gas inlet 32 to let gas in on the bottom surface. The center hole 31 is round with its outer portion as a ring, while the top 39 of said ring is higher than the top surface of the box body and has external thread on it. The outer portion of the center hole 31 and the box body compose to be a gas-dispersing chamber 38 in the shape of a cylinder. In order to disperse gas completely, the gas outlets 37 can be positioned equispacedly.

The mixing gas 20 is a cylinder, and has a countersunk hole 25 connected to the center hole 31. On the top of countersunk hole 25 there is a round mounting hole 29. An insulating sleeve 50 setting on the mounting hole 29 includes a round plate mounted in the countersunk hole 25 and a round ring 1 matched with the mounting hole 29. Said insulating sleeve 50 has a reflecting plate 40 connected to ground wire of ion flame controller. On the outer surface of the cylinder are positioned several inclined upward projection 22 and notches 21 spaced with each other. The angle inclined of said projection 22 and notches 21 can be 10 to 80 degree. On each notch 21 are several connecting holes 210 connected onto the countersunk hole 25, and the connecting hole 210 can be 0.5 to 3 mm in diameter. The cross section of the notches 21 can be square or inverted trapezoidal. In order to position more connecting hole 21 to disperse air better, the length of the notches 21 could be less than 50 mm, and the connecting hole 210 can be positioned on the notches 21 equispacedly.

The burner cover 10 and the top face of the mixing box 20 compose the second mixing chamber 100 for the swirly blend flow forming a spiraling flow. The burner cover 10 provides a flame hole 11 in the shape of a cone frustum for the mixture flow rushing out, the inclined surface of the cone frustum of the flame hole 11 reflects the spiraling blend flow to the reflecting plate 40 of the mixing box 20, then the spiraling blend flow rushes out of the flame hole 11 and form a rotating blend gas flow with its bottom tiny but top big.

In this patent application, ion flame detector is applied to detect, the accessories of ion flame detector include insulating sleeve 50 and reflecting plate 40, while the insulating sleeve 50 is made of glass fiber, and it includes a round ring 51 mounted onto the round plate, the reflecting plate 40 is a round plate made of metal.

Figure 5:
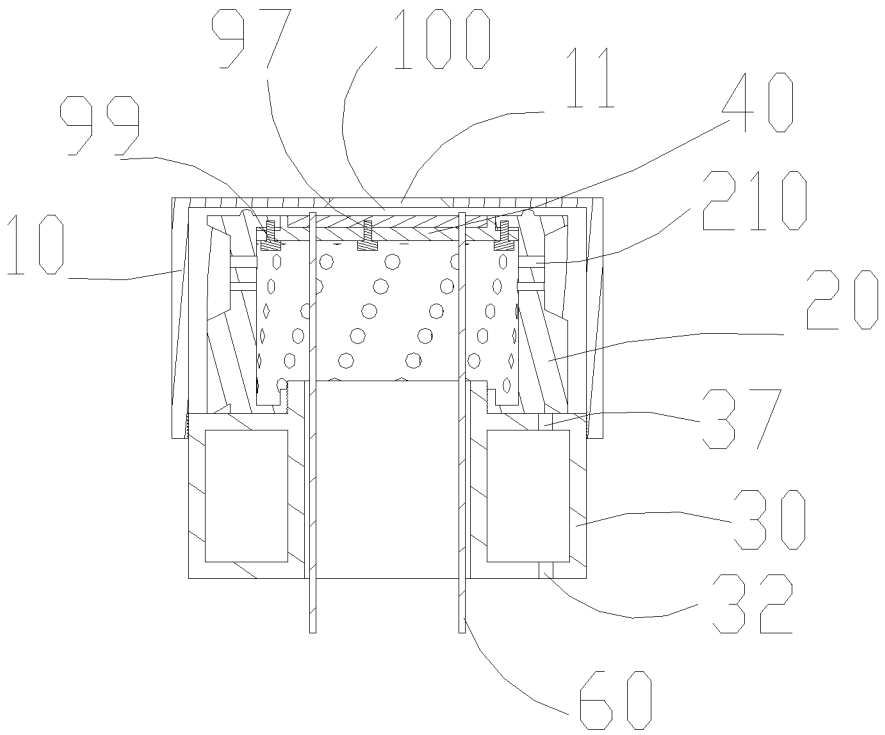
FIG. 5 is the assembled B sectional view of FIG. 3.
Figure 6:
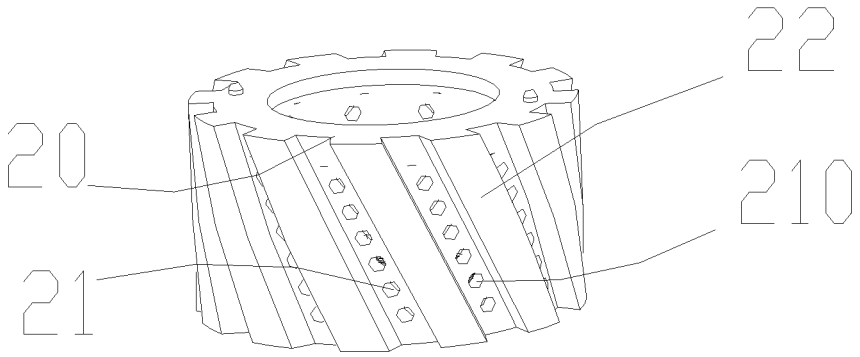
FIG. 6 shows the device for air dispersion and gas mixture in the first embodiment of the burner in present patent application.
Figure 7:
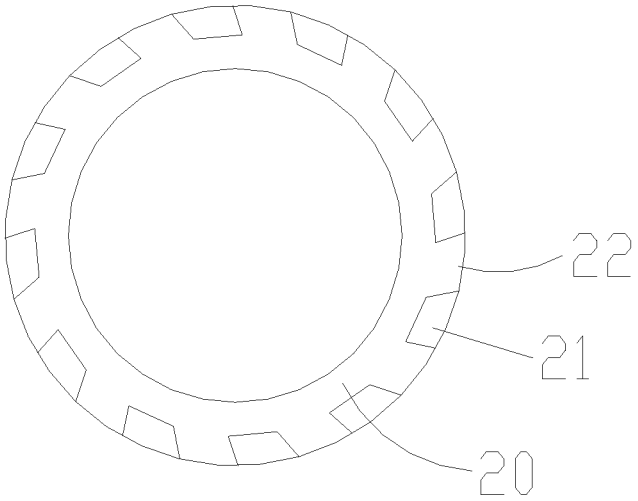
FIG. 7 is the top view of the mixing device of the burner in the first embodiment of present patent application.

The operation procedure of the embodiment of present patent application is as followed:

As FIG. 5, use screws 99 to fix the insulating sleeve 50 in the countersunk hole 25 onto the mixing box 20, and then fix the reflecting plate 40 made of metal onto the round ring 51 of the insulating sleeve 50, connect the ground wire of the ion flame detector to a insulated reflecting plate 40 by a screw 97 and the positive wire of the ion flame detector to the burner cover 10. When a flame burns the metal piece (e.g. Iron pan), the positive wire of the ion flame detector will sense the positive ion produced by the flame, thus the ion flame detector will tell that fire is detected.

The burner cover 10 includes a ring wall and top cap on the ring wall, while the top cap has a flame hole 11 in the shape of a cone frustum. In order to burn the gas fully, the size of top face of the flame hole 11 is selected as one fifth to one third of the size of the top cap. To facilitate igniting, in the burner of this patent application are mounted two pulse ignition devices 60.

In order to connect the burner cover 10 and gas-separating box 30 together, a internal thread 12 is set inside the burner cover 10 and corresponding external thread 380 is set outside the gas-separating box 30.

In order to connect the mixing box 20 and gas-separating box 30 together, a matched thread 250 and 35 are set on the inner wall of countersunk hole 25 of the mixing box 20 and on the outer ring of the center hole 31 of gas-separating box 30.

The work process of the burner in present patent application is as followed:

Seen from FIGS. 1, 4, 5 and 6, firstly, the air and gas are two separate flow, the flow of air enters the centre hole 31 and then the notch 21 through the equispaced connecting hole 210 while the flow of gas enters the gas-dispersing chamber 38 by the inlet 32 and then enters the notch 21 through gas outlet 37 to mix with the air flow, later, they rush along the inclined notch 21 and form to be a upward inclined rotating blend flow; the upward inclined mixture flow enters the second mixing chamber 100 and mix a second time rotationally to form a swirly blend flow. The swirly blend flow and rotating blend flow collide with each other and flow around. Since the cone frustum surface of the flame hole 11 reflects the mixture flow to the reflecting plate to make it rush up to the flame hole 11, which helps to form a spiraling blend flow with its bottom tiny but the top big. Such a spiraling blend flow when be ignited will become a flame like a hurricane which has a tiny bottom but a huge top. The flame like a hurricane is more concentrated and condensed. The energy produced by the flame burning will do no heat conduction with the burner head when the flame burns outside the burner head, which will bring about the effect of being hard to be extinguished, energy saving and less production of carbon monoxide. The concentration and condensation of the flame reduce the length of the flame, which will help the heat to stay rather than loss, and help the flame to burn in a small space. Short flame will decrease the contact of the flame to outer air, which can reduce the heat loss, reduce the volume of the burner chamber and in further the volume of the burner head. What's more, for those gas of different density such as gas of light density, the notches 21 can be made to be at an angle of 80 or even 90 degree with the bottom surface of the mixing box 30, which will contribute full mixing of the mixture gas reflected by the cone frustum surface of the flame hole 11, while those gas with high density such as that in present patent application can be reflected by the cone frustum surface after two mixing processes.

Besides, a fan can be used to control the input of the air in the central hole 31 to ensure that there is adequate air to mix with the gas, which will reduce the production of carbon monoxide as burning, and has a effect of energy saving and environment protection.

Figure 8:
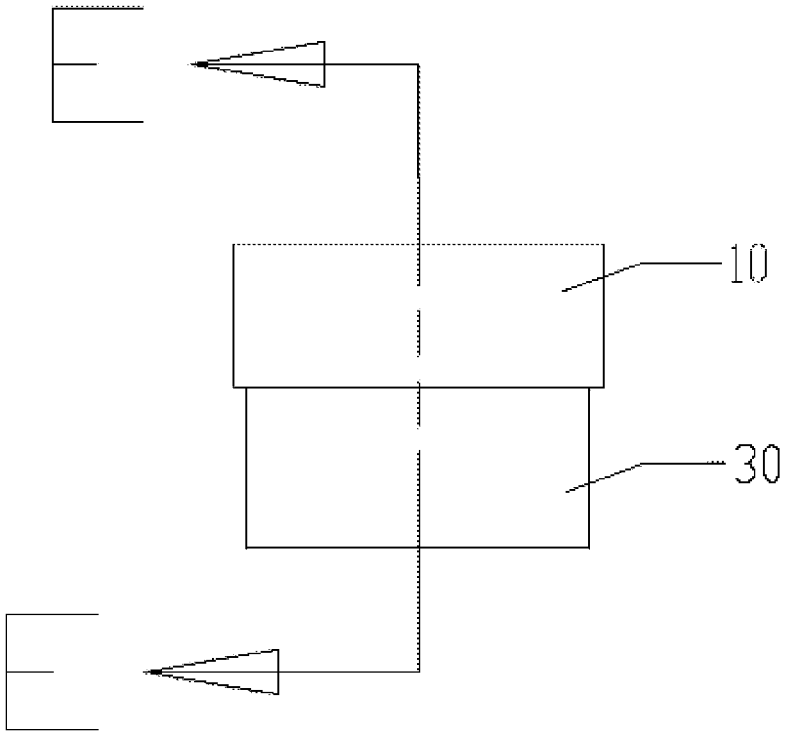
FIG. 8 is the front view of the mixing device of the burner in the second embodiment of present patent application.
Figure 9:
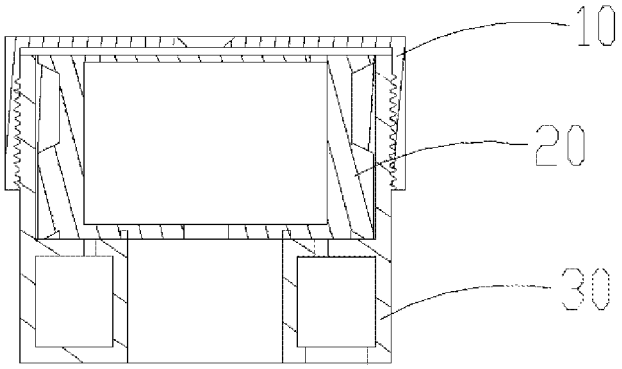
FIG. 9 is E sectional view of FIG. 8.
Figure 10:
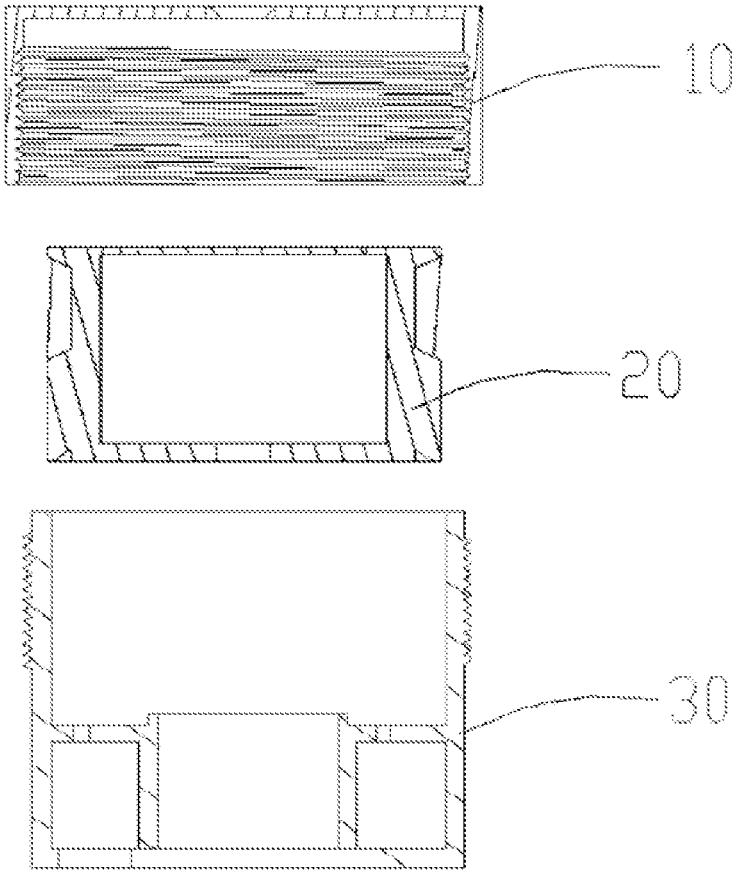
FIG. 10 is the exploded sectional view of the mixing device in a second embodiment of present patent application.
Figure 11:
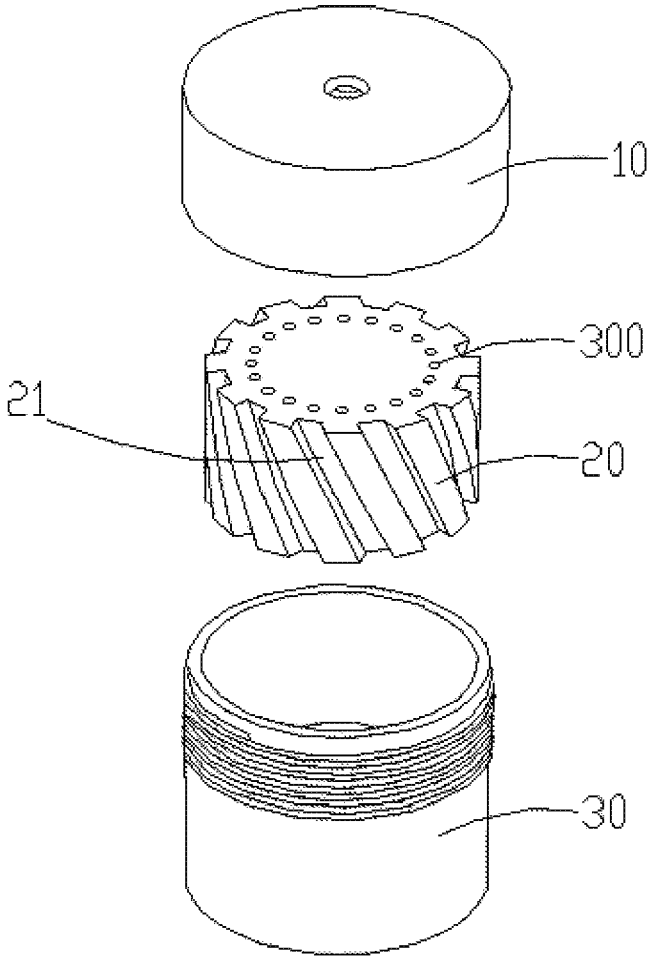
FIG. 11 is the exploded block diagram of the mixing device in a second embodiment of present patent application.

The FIG. 8 to 10 show the second embodiment of present patent application, wherein the difference between the first and the second embodiment is: on the top surface of the mixing box 20 are several first outlets 300 positioned along a circle, and there is no connecting hole 210 between the countersunk hole 25 and the notches 21, the air enters into the gas outlet 37 in the gas-separating box 30 and then the notches 21 and keep going up, then forms rotating air flow. The gas enters into the first outlet 300 equispaced on the top surface of the mixing box 20 and then the second mixing chamber 100, and then mix with rotating air flow to form swirly flow. The swirly blend flow and rotating blend flow collide with each other and flow around. Due to the inclined surface the cone frustum of the flame hole, the blend flow can be reflected to the reflecting plate and then rush up to the flame hole to form a spiraling mixture gas flow with its bottom tiny but the top big which when ignited will become a flame like a hurricane which also has a tiny bottom but big top. The other aspect is the same as that of the first embodiment, so no need to repeat.

Figure 12:
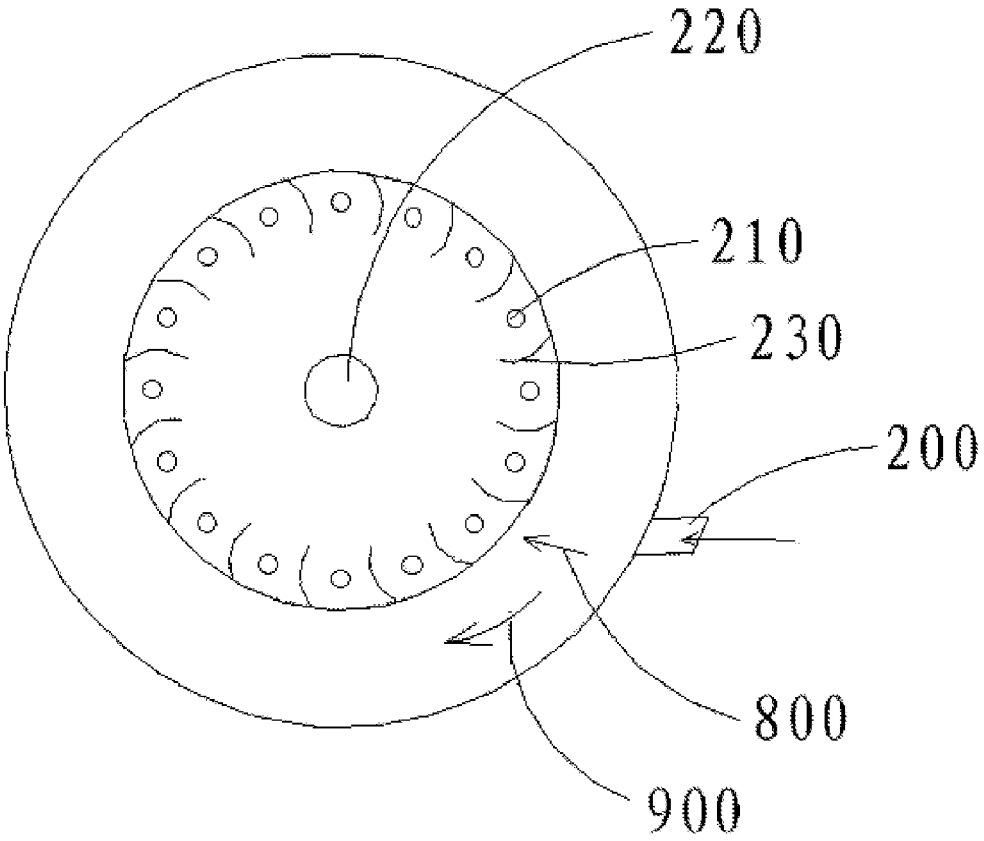
FIG. 12 is a third embodiment of the burner of present patent application.

FIG. 12 shows the third embodiment of this patent application which includes a ignition 220, gas inlet 210, flow divider 230, air inlet 200, wherein the air inlet 200 is a circle pipe of which the center line is non-intersected with that of the burner, the flow divider 230 are arc plates equispaced. The work process is as followed:

The air enters into the burner from the air inlet 200 to form a rotating air flow 900, while a portion of the air flow 900 flow along the circle and the other portion mix with the gas from the gas inlet 210 to form a swirly flow and then burn.

This patent application is described referring some embodiment. The skilled in this art should comprehend that various modification and equal replacement for the characteristics and embodiment not beyond the spirit and scope of present patent application is available. In light of present patent application, modification on the characteristics and embodiments to adapt to specific situation and material is also won't beyond the spirit and scope of present patent application. Therefore, this patent application is not limited into what has been disclosed, all the embodiment in the scope of the claims belong to the protection scope of present patent application.

What is claimed is:

1. A burner, comprising:

a gas-separating box (30) used to import fuel gas and air respectively, which has a centric hole (31) through which the air enters and at least one inlet (32) through which the fuel gas enters, and several fuel gas outlets (37) are provided on a top surface of said gas-separating box (30); and a mixing device used to mix the air and the fuel gas from the gas-separating box (30) to form a rotating mixed flow;

wherein said mixing device comprises a burner cover (10) and a mixing box (20), and said burner cover (10) is in a shape of sleeve;

said mixing box (20) has a countersunk hole (25) communicated with the centric hole (31), on a side wall of the mixing box (20) several grooves (21) inclined upwards are disposed at a distance from each other, whose amount and position are corresponding to that of fuel gas outlets (37), and communicating holes (210) are disposed on a surface of the grooves (21), communicating with air in said countersunk hole (25), and the grooves (21) mix the air and the fuel gas primarily to form the rotating mixed flow inclined upwardly;

a top surface of said burner cover (10) and a top face of said mixing box (20) compose the second mixing chamber (100) for the rotating mixed flow to form a spiraling flow;

a flame hole (11) on the top surface of the said burner cover (10) for the rotating mixed flow to rush out has a frustoconic surface, which makes the rotating mixed flow be reflected onto a reflecting plate (40) on the mixing box (20) and then rush out of the flame hole (11) to form the spiraling flow with a bottom smaller than a top end.

2. The burner according to claim 1, wherein an angle between said grooves (21) and a bottom surface of the mixing box (20) is 10 to 80 degrees; said grooves (21) are at least 50 mm long; and cross section of said grooves (21) is in a shape of square or inverted trapezoidal.

3. The burner according to claim 1, wherein an area of the flame hole (11) is one fifth to one third an area of the top surface of the burner cover.

4. The burner according to claim 1, wherein the fuel gas outlets (37) are evenly distributed, while the communicating holes (210) are evenly distributed too; diameter of the fuel gas outlets (37) are 0.5 to 3 mm, and diameter of the communicating holes (210) are 0.5 to 3 mm; and said burner cover (10) is screwed with the gas-separating box (30).

* * * * *